US006793516B1

(12) United States Patent
Mamas

(10) Patent No.: US 6,793,516 B1
(45) Date of Patent: Sep. 21, 2004

(54) ELECTRICAL PIVOTAL LEVER CONNECTOR

(76) Inventor: Anthony Mamas, 49 Clemson Rd., Cherry Hill, NJ (US) 08034

( * ) Notice: Subject to any disclaimer, the term of this patent is extended or adjusted under 35 U.S.C. 154(b) by 0 days.

(21) Appl. No.: 10/630,676

(22) Filed: Jul. 31, 2003

(51) Int. Cl.[7] ..... H01R 13/625

(52) U.S. Cl. ..... 439/344; 439/352; 439/729; 439/822; 439/676

(58) Field of Search ..... 439/344, 352–358, 439/822, 729, 676

(56) References Cited

U.S. PATENT DOCUMENTS 3,761,869 A 9/1973 Hardesty et al.
3,860,316 A 1/1975 Hardesty
4,941,839 A * 7/1990 Nagasaka et al. ..... 439/352
5,163,848 A * 11/1992 Maeda et al. ..... 439/489
6,394,824 B1 * 5/2002 Huang ..... 439/108
6,485,315 B1 * 11/2002 Hwang ..... 439/108
6,612,859 B2 * 9/2003 Yeomans et al. ..... 439/354

* cited by examiner

*Primary Examiner*—Truc T. T. Nguyen

(57) ABSTRACT

A pivoting lever which is part of a connector plug used to connect an electrical cord to a jack of a telephone, computer, other electrical device or other terminal housing. The pivoting lever is part of the mechanism used to lock the plug to a jack of electronic devices or other terminal housings. Compression of the pivoting lever against a matter of opposing force allows the lever to return to its original state thereby allowing the locking of the connector plug to a jack cavity of an electronic device as well as providing for the connector plug's from an electronic device or terminal housing when the lever is compressed.

1 Claim, 2 Drawing Sheets

ELECTRICAL PIVOTAL LEVER CONNECTOR

BACKGROUND OF THE INVENTION:

This invention relates to an improvement in electrical connecting devices. In the telephone and computer industries, there has been continued and increased use of plug type connectors on electrical cords which are used to connect an electronic device, such as a computer or telephone, to the jack of another electrical device or other terminal housing.

However, one major problem has been when extensive use of compression of the lever portion of the connector plug is made, the lever portion of the connector plug breaks, since it is formed integrally with the plug housing, thus not abling the connector plug to anchor itself to another electronic device, jack or housing terminal. Frequent switching between a telephone jack and a computer jack are examples of what can lead to strain and consequently, breakage of the lever portion of the connector plug. Prior art shows currently that the lever portion of the connector plug is in a fixed position only relying on its natural resilience to resume its original molded shape and orientation.

By way of example, Hardesty et al. U.S. Pat. No. 3,761,869 and Hardesty, Hall U.S. Pat. No. 3,860,316, show electrical connecting devices where the lever of such devices is in a fixed state of being only relying on its natural resilience to resume its original molded shape and orientation.

SUMMARY OF THE INVENTION:

Against the foregoing background, it is a primary object of this invention to provide a pivoting lever which is part of a connector plug used to connect an electric cord to the jack of a telephone, computer, other electronic device or other terminal housing. It is a further object of the present invention to provide a matter of opposing force thereby allowing the lever to return to its original state thus allowing the locking of the connector plug to a jack cavity of an electronic device or other terminal housing as well as providing for the connector plug's release from an electronic device or other terminal housing when the lever is compressed.

The connector plug of this invention is similar to those previously referenced except that the lever portion of the plug is able to pivot and is not formed integrally with the connector plug housing. Another improvement is the use of a matter of opposing force which will allow the lever to return to its original state.

Figure 1:
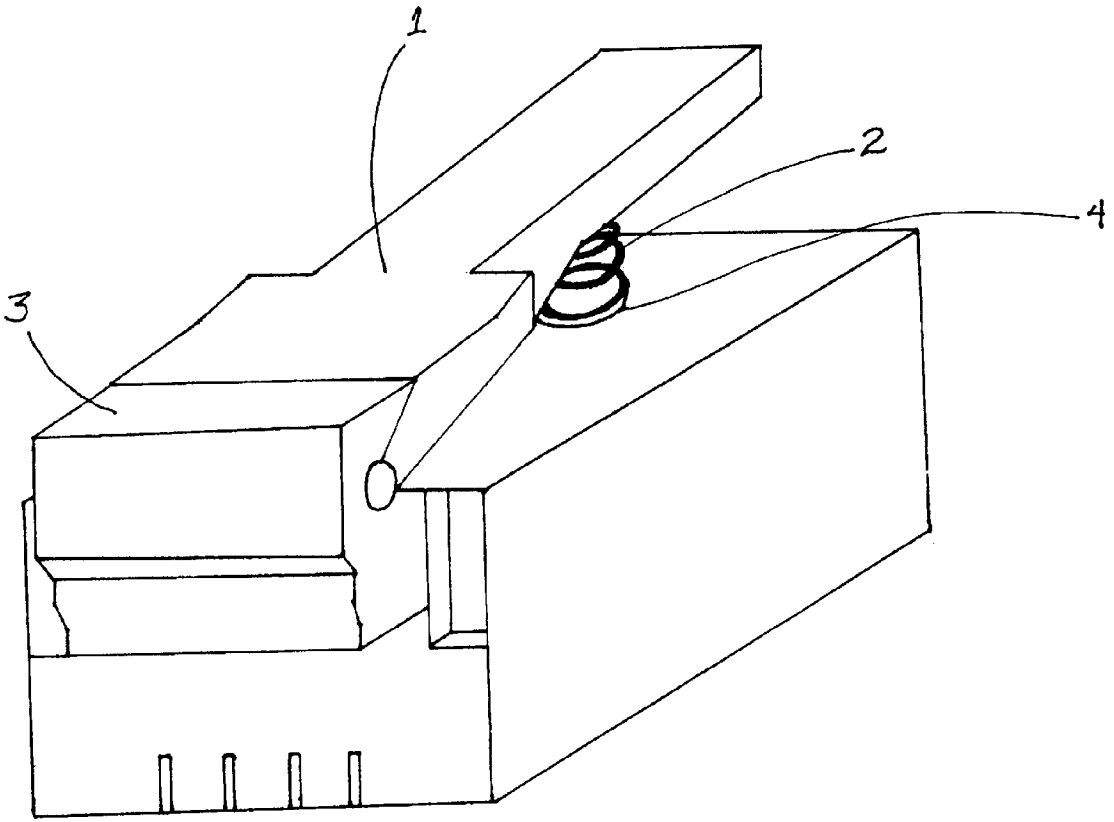
FIG. 1 is a perspective view of the connector plug embodying the principals of this invention. Namely, the pivotal lever, matter of opposing force and angled front end of the housing that enable the lever to return to its original state and position after being released from compression.
Figure 2:
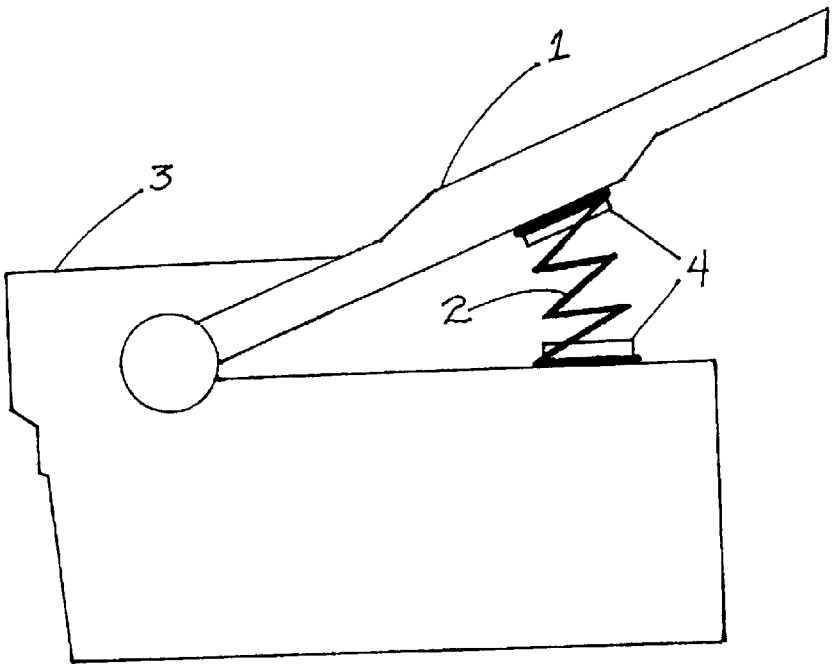
FIG. 2 is a side view of the elements mentioned in FIG. 1.

DETAILED DESCRIPTION OF THE INVENTION:

Referring to FIGS. 1 and 2, there is shown the housing 3 of the connector plug where the front end of the housing next to the pivotal lever 1 forms a barrier, thereby acting as a stopper to the pivotal lever 1 when the lever is released from compression. Compression of the pivoting lever 1 against a matter of opposing force 2 (a spring 2 is shown for illustrative purposes as a matter of opposing force) allows the lever to return to its original state and position thereby allowing the locking of the connector plug to a jack cavity of an electronic device or other terminal housing as well as providing for the connector plug's release from an electrical device or terminal housing when the lever is compressed.

As shown in FIG. 2, the matter of opposing force would be connected or held in place to the pivotal lever, the housing itself or both lever and housing 4. If a spring is used as the matter of opposing force, the spring would be held in place between the pivotal lever 1 and the housing 3. The holding in place of the spring 2 between the pivotal lever 1 and housing 3 may be accomplished by protruding reliefs 4 formed integrally with the pivotal lever and housing. My improved design will greatly reduce strain and breakage of the lever portion of the plug connector due to extensive compression and release. Concerning the above description, it is to be realized that construction, materials, dimensions, assembly, shape, function, operation and variations thereof, are readily available to one skilled in the art whereby those skilled in the art can make use of the invention without extensive experimentation, and further, all equivalent relationships to those illustrated in the drawings and described in the specifications are intended to be encompassed by the present invention.

Therefore, the foregoing is considered as illustrative only of the principles of the invention. In addition, since numerous modifications often times occur to those skilled in the art, it is not intended to limit this invention to the exact construction, materials, dimensions, assembly, shape, function and operation illustrated and described. Therefore, all suitable modifications and equivalents may be resorted to, falling within the scope of the invention.

I claim:

1. An improvement of an electrical connector plug used to connected electrical cords to a jack of a telephone, computer, other electronic device or other terminal housing, the improvement comprise of:

an electrical connector plug housing;

a pivoting lever that is not formed integrally with the electrical connector plug housing, but is attached thereto, having a pivotal end and a tapered bearing surface adjacent to the pivotal end;

a front end of the electrical connector plug housing which forms a barrier; and an opposing force means connected or held between the pivoting lever and the housing;

wherein the barrier includes an acute-angle shaped recess to engage the pivotal end and against the tapered bearing surface thereby acting as a stopper when the pivoting lever is released from compression.

* * * * *